US008992177B2

(12) United States Patent
Wu et al.

(10) Patent No.: US 8,992,177 B2
(45) Date of Patent: Mar. 31, 2015

(54) HIGH SOLIDITY AND LOW ENTRANCE ANGLE IMPELLERS ON TURBINE ROTOR DISK

(75) Inventors: Charles C. Wu, Glastonbury, CT (US); Kevin N. McCusker, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 602 days.

(21) Appl. No.: 13/289,446

(22) Filed: Nov. 4, 2011

(65) Prior Publication Data

US 2013/0115081 A1 May 9, 2013

(51) Int. Cl.

| | |
|---|---|
| ***F01D 5/18*** | (2006.01) |
| ***F01D 5/08*** | (2006.01) |
| ***F01D 5/30*** | (2006.01) |

(52) U.S. Cl.

CPC ..... *F01D 5/187* (2013.01); *F01D 5/082* (2013.01); *F01D 5/3007* (2013.01)

USPC ..... 416/1; 415/115; 415/174.3

(58) Field of Classification Search

CPC ..... F01D 5/18; F01D 5/081; F01D 5/082; F01D 5/085; F01D 5/087; F01D 5/088

USPC ..... 415/1, 115, 116, 174.3; 416/1, 95, 96 R, 416/97 R

See application file for complete search history.

(56) References Cited

U.S. PATENT DOCUMENTS

| | | | | |
|---|---|---|---|---|
| 3,826,084 | A * | 7/1974 | Branstrom et al. | 60/806 |
| 4,439,104 | A | 3/1984 | Edmonds | |
| 4,844,695 | A | 7/1989 | Banks et al. | |
| 5,772,397 | A * | 6/1998 | Morris et al. | 415/115 |
| 6,468,032 | B2 | 10/2002 | Patel | |
| 2005/0013686 | A1* | 1/2005 | Schiavo | 415/115 |
| 2006/0120855 | A1* | 6/2006 | Djeridane et al. | 415/115 |
| 2006/0269399 | A1* | 11/2006 | Girgis et al. | 415/115 |
| 2006/0269400 | A1* | 11/2006 | Girgis et al. | 415/115 |
| 2011/0123325 | A1* | 5/2011 | Morris et al. | 415/208.1 |

* cited by examiner

*Primary Examiner* — Dwayne J White
*Assistant Examiner* — Brian P Wolcott
(74) *Attorney, Agent, or Firm* — Carlson, Gaskey & Olds P.C.

(57) ABSTRACT

According to an embodiment disclosed herein, an apparatus for cooling a rotating part having cooling channels therein, the rotating part attaching to a disk rotating about an axis, the disk having a conduit for feeding a cooling fluid to the cooling channel is described. The apparatus has a first impeller rotating with the disk and in register with the conduit and an outer periphery of the disk, the impeller directing the cooling flow to the conduit.

11 Claims, 4 Drawing Sheets

HIGH SOLIDITY AND LOW ENTRANCE ANGLE IMPELLERS ON TURBINE ROTOR DISK

TECHNICAL FIELD

The invention is applicable to a gas turbine engine cooling system and more particularly to an improved apparatus for supplying cooling fluid to hot parts of the engine, specifically, the interior of the turbine blade.

BACKGROUND OF THE INVENTION

It is widely recognized that the efficiency and energy output of a gas turbine engine can be improved by increasing the operating temperature of the turbine. Under elevated operating temperatures, gas turbine engine components such as the turbine rotors and blades are cooled by a flow of compressed air discharged at a relatively cool temperature. The flow of coolant across the turbine rotor and through the interior of the blades removes heat so as to prevent excessive reduction of the mechanical strength properties of the blades and rotor.

Therefore on the one hand the turbine operating temperature, efficiency and output of the engine are limited by the high temperature capabilities of the various turbine elements and the materials of which they are made. In general the lower the temperature of the elements the higher strength and resistance to operating stresses. On the other hand the performance of the gas turbine engine is very sensitive to the amount of air flow that is used for cooling the hot turbine components. The less air that is used for cooling functions the better the efficiency and performance of the engine.

To cool the turbine blades, a flow of cooling air is typically introduced. There are two ways to deliver cooling air to turbine blades. One is from stationary part and other is from rotating part. From a stationary part, the cooling flow is introduced with a swirl or tangential velocity component through use of a tangential on board injector with nozzles directed at the rotating hub of the turbine rotor. From a rotating part, a flow of cooling air is typically introduced at a lower radius as close as possible to the engine shaft, such as underneath of the rotor disk bore.

SUMMARY OF THE INVENTION

According to an embodiment disclosed herein, an apparatus for cooling a rotating part having cooling channels therein, the rotating part attaching to a disk rotating about an axis, the disk having a conduit for feeding a cooling fluid to the cooling channel is described. The apparatus has a first impeller rotating with the disk and in register with the conduit and an outer periphery of the disk, the impeller directing the cooling flow to the conduit.

According to a further embodiment disclosed herein, an apparatus for directing a cooling fluid through a conduit to a rotating part, includes a first impeller in register with the conduit, the impeller having a shape that changes the direction of cooling fluid that is rotating tangentially relative to the conduit to flowing axially to the conduit.

According to a further embodiment disclosed herein, a method of cooling a turbine blade disposed in a gas turbine engine is described. The method includes providing a broach slot for providing cooling air to a base of the turbine blade and turning cooling air from rotating tangentially relative to the slot to passing axially to the broach slot.

These and other features of the invention would be better understood from the following specifications and drawings, the following of which is a brief description.

DETAILED DESCRIPTION

Figure 1:
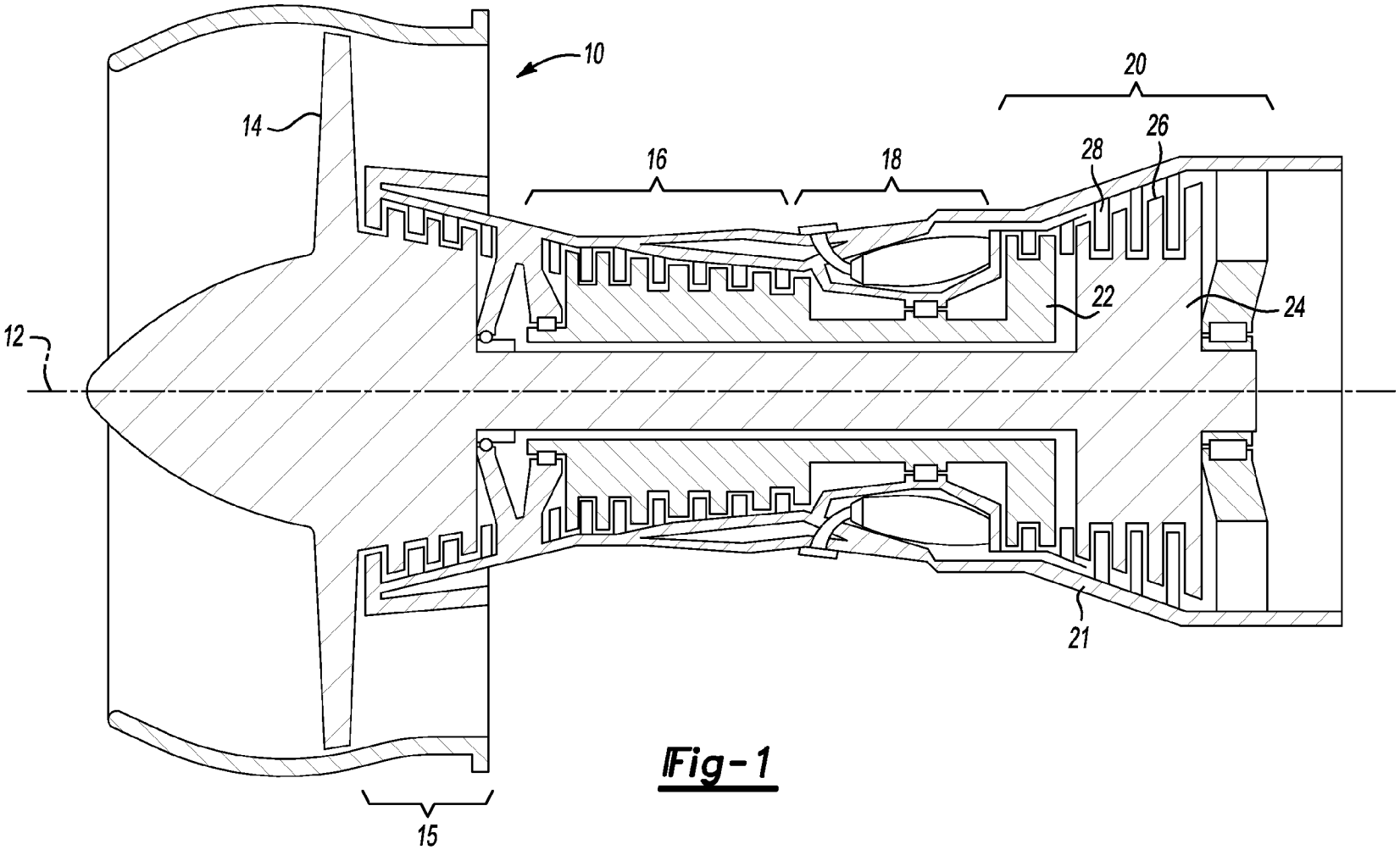
FIG. 1 is an embodiment of a gas turbine engine employing an embodiment disclosed herein.

Referring to FIG. 1, a gas turbine engine 10, such as a turbofan gas turbine engine 10, circumferentially disposed about an engine centerline, or axial centerline axis 12, is shown. The engine 10 includes a case 21, a fan 14, compressor sections 15 and 16, a combustion section 18 and a turbine 20. As is well known in the art, air compressed in the compressor 15/16 is mixed with fuel and burned in the combustion section 18 and expanded in turbine 20. The turbine 20 includes high pressure and low pressure turbine rotors 22 and 24, which rotate in response to the expansion. The turbine 20 comprises alternating rows of rotary airfoils or blades 26 and static airfoils or vanes 28. It should be understood that this view is included simply to provide a basic understanding of the sections in a gas turbine engine, and not to limit the invention. For example, while a fan 14 is shown, this invention may be used in turbines that do not include a fan section.

Figure 2:
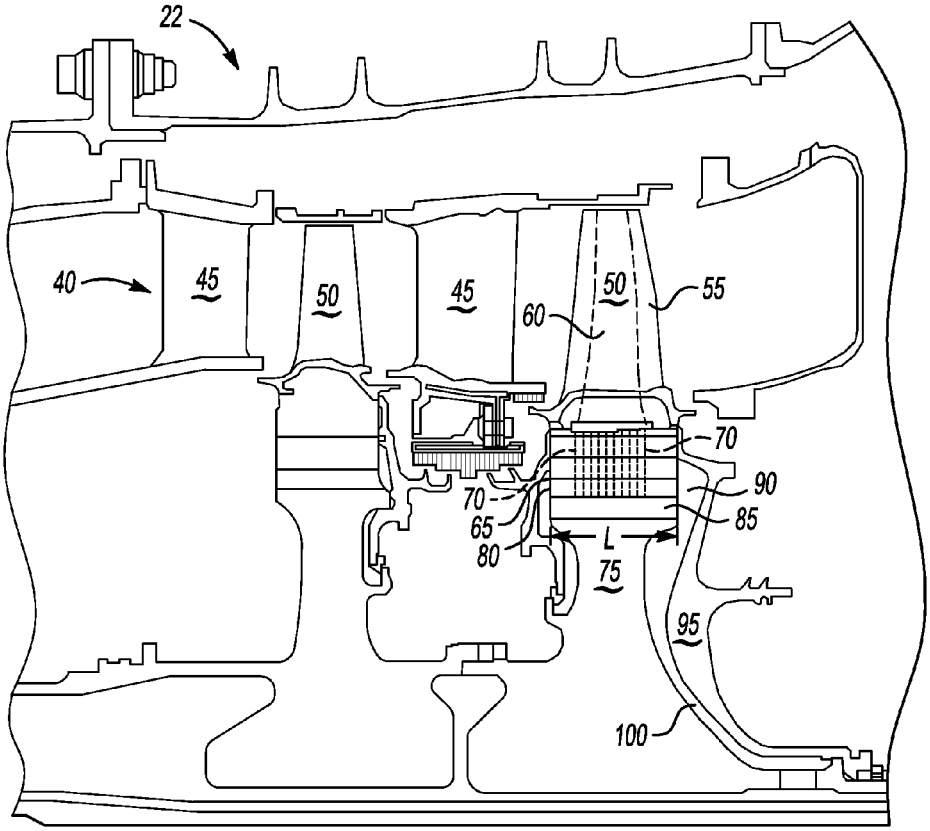
FIG. 2 is a schematic depiction of a turbine section of the engine of FIG. 1.
Figure 3:
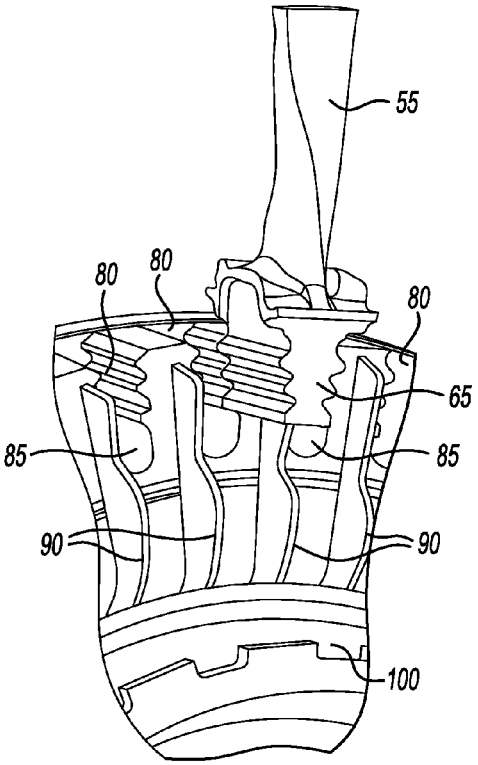
FIG. 3 is a schematic, cut-away view, partially in phantom of a disk of the turbine section of FIG. 2.

Referring now to FIGS. 2 and 3, the high pressure turbine area 22 is shown in more detail. A combustion gas path 40 passes by stationary vanes 45 and rotatable turbine blades core 50. Each turbine blade core 50 has an airfoil section 55 that has a hollow interior 60 and a base 65 shaped like an inverted Christmas tree or other shape that is known for holding the turbine blade core 50 within a disk 75. A plurality of passageways 70 pass through the base 65 to deliver cooling to the hollow interior 60 of the turbine blade core 50. Disk 75 has a plurality of cutouts 80 that have a shape to mate with the base 65 of each turbine blade cores 50. A broach slot 85 forms an area beneath each installed blade and extends along a length L of the base 65 for sending a cooling fluid such as air through the passageways 70 into the hollow of interior 60 to cool the turbine blade core 50 that extends within the combustion gas path 40 to provide rotative force to the turbine blade cores 50.

Figure 4:
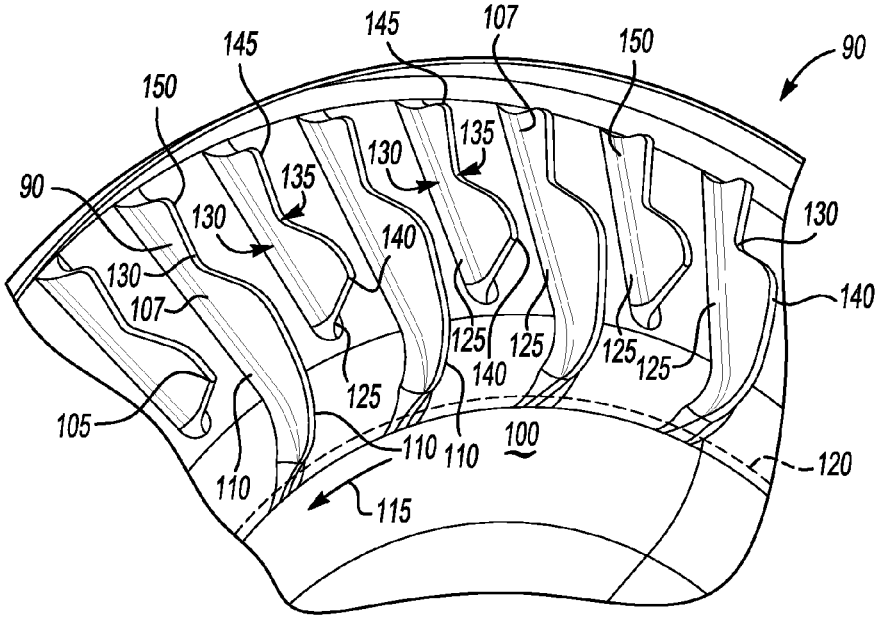
FIG. 4 is a schematic sectional view of a further embodiment of the disk of FIG. 3.

Referring now to FIGS. 3 and 4, impellers 90 are machined into the disk 75 or into the bore cover plate 95 that attaches to the disk 75. For ease of illustration, the impellers 90 are shown attached to either turbine disks 75 or bore cover plate 95. However, one of ordinary skill in the art will recognize that the impellers may be placed in other areas and on other disks within the gas turbine engine 10 to cool components that may need cooling. A conduit 100 directs cooling air from the compressor 15/16 as is known in the art.

Referring again to FIGS. 3 and 4, one can see a base 65 of a turbine blade core 50 disposed within a cutout 80 around the disk 75. Broach slots 85 are shown below each base 65. Impellers 90 are spaced apart to enable each impeller 90 to direct cooling air within the conduit 100 into the broach slots 85 to provide cooling air to the interior of the turbine blade cores 50 and airfoils 55.

Some impellers 90 have a J-shaped body 105 that has a radially extending part 107 that extends axially aft from bore cover plate 95. The radially extending part 107 smooths into an extension 110 that is perpendicular to the part 107 and tangential to airflow 115 (moving counter-clockwise in this application though clockwise is possible in other applications) in the conduit 100. The extensions 110 about the bore cover plate 95 form an imaginary perimeter 120 about the interior of the bore cover plate 95 and are disposed at an angle of 0-5 degrees relative thereto. Each of the part 107 and extension 110 smooth into the bore cover plate 95 by means of rounded beads 125. The body 105 has a saddle 130 at an intermediary portion 135 thereof, at upper peak 140 and a lower peak 145. The cover plate 95 conforms to the shape of the saddle 125, the upper peak 140 and the lower peak 145 so that cooling air does not flow over the impellers 90, 150 only between them.

Some impellers 150 do not have an extension 110 to save weight and may be interspersed between impellers 90 that have the extension 110. Typically there is one impeller to direct air to each broach slot 85 (See FIG. 5B). The part 107 is the same in the impellers 90 and 150. Each broach slot 85 is disposed between and in register with the upper peaks 140 of a pair of impellers 90 or impellers 90, 150.

Figure 5A:
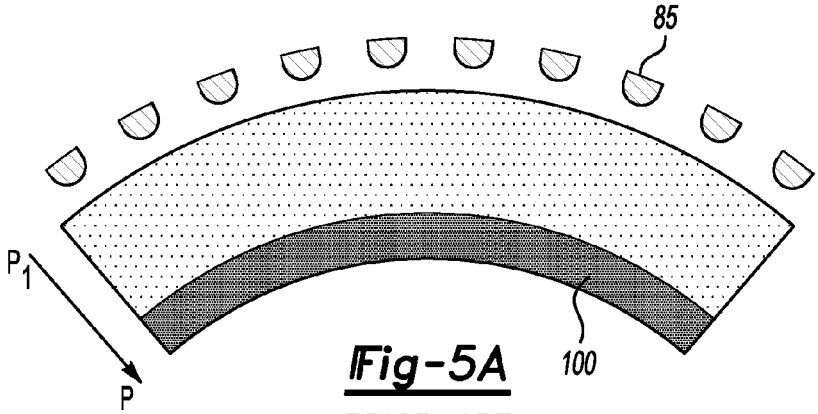
Fig-5A PRIOR ART
FIGS. 5A and 5B are graphical depictions comparing a prior art disk with and embodiment of the present invention.
Figure 5B:
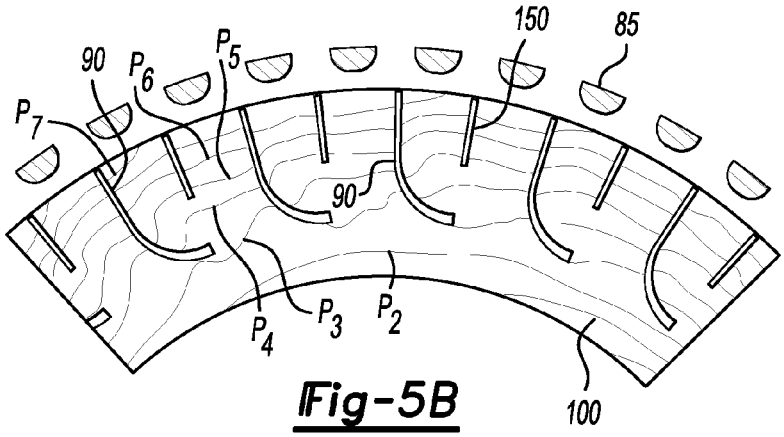

Referring to FIG. 5A, the effects of air flowing to each broach slot 85 are shown. Air enters the conduit 100 at a given pressure P that tends to diminish to $P_1$ in the conduit 100 as the volume of the conduit 100 increases towards the broach slots 85. Referring now to FIG. 5B, it is seen that with the impellers 90, 150 urging the cooling air into the broach slots 85, pressure within the broach slot 85 increases radially outwardly within the conduit 100 along each pressure lines $P_2$, $P_3$, $P_4$, $P_5$, $P_6$, $P7_7$, as an example, with the use of the impellers, thereby increasing the amount of cooling air passing through the blades 50. If there are no impellers, pressure within the cavity defined by the conduit 100 is increased far less as one extends radially outwardly as the conduit gets closer to the broach slots. By adding the impellers, the pressure increases much more as the air approaches the broach slot.

Figure 6A:
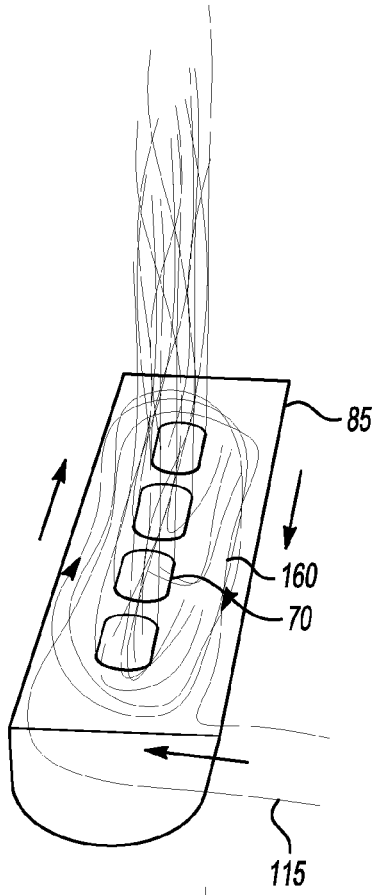
Fig-6A PRIOR ART
FIGS. 6A and 6B are graphical depictions comparing a prior art disk with and embodiment of the present invention.
Figure 6B:
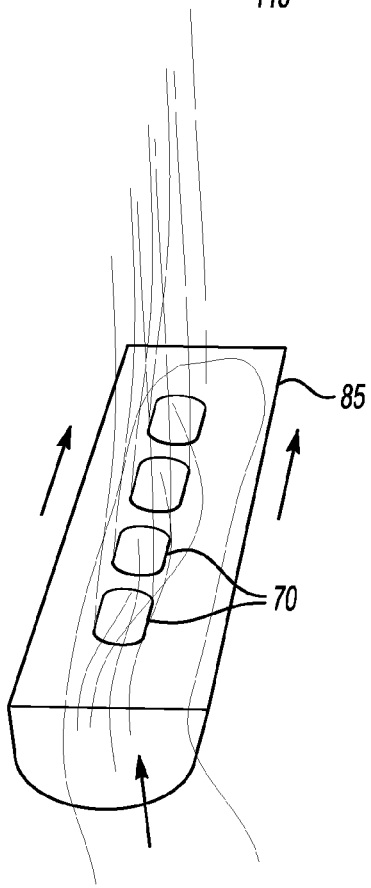

Referring to FIGS. 6A and 6B, if impellers 90, 150 are not included in the conduit 100, the cooling air rotates at a swirl ratio much less than 1. Referring to FIG. 6A, if the cooling air gets into the turbine blade broach 85 the swirl ratio is 1. The mismatch of the swirl ratios results in a large flow recirculation zone 160 which causes pressure loss and lower static pressure to feed the turbine blades for cooling thereof. Installing impellers 90, 150 on the bore cover plate 95 turns the cooling air flow 115 from tangential to the broach slots 85 to radially thereto before flow gets into the blade broach slot which thereby minimizes the large flow recirculating zone 160 inside the broach slot. The overall static pressure of cooling air supplied to the turbine blade cores 50 is higher and that can overcome the pressure fluctuations caused by engine operation to guarantee the cooling safety margin.

By adding the impellers, the higher swirl ratio increases the pressure of the cooling air flow within the turbine rotor cavity before it enters a broach slot 85. The low entrance angle of the extension 110 of the impellers 90 relative to the cooling air flow A is very small, between zero and five degrees since this arrangement will produce the least flow loss. The idea is to turn flow from tangential to radial with minimum flow loss minimal heat gain. The extension 110 and the beads 125 are shaped to turn the airflow 115 with minimal flow losses and heat gains.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. An apparatus for cooling a rotating part having a cooling channels therein, said rotating part attaching to a disk rotating about an axis, said disk having a conduit for feeding a cooling fluid to said cooling channel, said apparatus comprising:

a first impeller rotating with said disk and in register with said conduit and an outer periphery of said disk, said first impeller directing said cooling fluid to said conduit, wherein said first impeller has a radial portion and an extension, said radial portion and said extension form a J-shape; and a second impeller adjacent said first impeller, wherein said second impeller lacks an extension, wherein said radial portion and said second impeller each have a saddle disposed at a radially intermediate portion thereof, wherein said radial portion and said second impeller each have an upper peak and a lower peak, said saddles disposed radially between said upper and lower peaks, said saddles each having a dimension less than both said lower and upper peaks in a direction parallel to said axis.

2. The apparatus of claim 1 wherein said extension leads said radial portion as said first impeller rotates about said axis.

3. The apparatus of claim 1 wherein said extension smoothes into said radial portion to minimize pressure losses of said cooling fluid as said cooling fluid passes along said first impeller.

4. The apparatus of claim 1 wherein said first impeller is machined into a surface of said disk or a bore cover plate.

5. The apparatus of claim 4 wherein said first impeller smoothes into said surface of said disk to minimize pressure losses of said cooling fluid as said cooling fluid passes thereby.

6. The apparatus of claim 1 wherein said conduit is disposed between said first impeller and said second impeller.

7. The apparatus of claim 1 wherein said extension intersects said cooling fluid adjacent thereto at zero to five degrees.

8. The apparatus of claim 1 further comprising a cover enclosing said first impeller such that cooling fluid does not flow axially around said first impeller.

9. A method of cooling a turbine blade disposed in a gas turbine engine, said method comprising:

providing a slot for providing cooling air to a base of said turbine blade;

turning cooling air from rotating tangentially relative to said slot to passing axially to said slot;

providing a first impeller adjacent one side of said slot, said first impeller having a radial portion and an extension, said radial portion and said extension form a J-shape; and providing a second impeller adjacent a second side of said slot, said second impeller lacks an extension, wherein said radial portion and said second impeller each have a saddle disposed at a radially intermediate portion thereof, wherein said radial portion and said second impeller each have an upper peak and a lower peak, said saddles disposed radially between said upper and lower peaks, said saddles each having a dimension less than both said lower and upper peaks in a direction parallel to said axis.

10. The apparatus of claim 1, wherein said lower peak is radially outward of said upper peak, and said lower peak having a height less than said upper peak.

11. The apparatus of claim 9, wherein said lower peak is radially outward of said upper peak.

* * * * *